US006764989B1

(12) United States Patent
Huish et al.

(10) Patent No.: US 6,764,989 B1
(45) Date of Patent: Jul. 20, 2004

(54) LIQUID CLEANING COMPOSITION CONTAINING α-SULFOFATTY ACID ESTER

(75) Inventors: Paul Danton Huish, Salt Lake City, UT (US); Laurie A. Jensen, Midvale, UT (US); Pule B. Libe, Salt Lake City, UT (US)

(73) Assignee: Huish Detergents, Inc., Salt Lake City, UT (US)

( * ) Notice: Subject to any disclaimer, the term of this patent is extended or adjusted under 35 U.S.C. 154(b) by 0 days.

(21) Appl. No.: 09/677,271

(22) Filed: Oct. 2, 2000

(51) Int. Cl.[7] ..... C11D 17/50

(52) U.S. Cl. ..... 510/357; 510/424; 510/426; 510/428; 510/446; 510/447; 510/488; 510/400; 510/492; 510/501; 510/506

(58) Field of Search ..... 510/414, 128, 510/137, 138, 155, 154, 445, 446, 447, 488, 492, 400, 501, 506, 357, 424, 426, 428

(56) References Cited

U.S. PATENT DOCUMENTS

| | | | | |
|---|---|---|---|---|
| 3,997,576 | A | 12/1976 | Oghoshi et al. | |
| 4,367,169 | A | 1/1983 | Matsushita et al. | |
| 4,374,056 | A | 2/1983 | Watanabe et al. | |
| 4,438,025 | A | 3/1984 | Satsuki et al. | |
| 4,487,710 | A | 12/1984 | Kaminsky | |
| 4,488,989 | A | 12/1984 | Lamberti | |
| 4,597,898 | A * | 7/1986 | Vander Meer | 252/529 |
| 4,705,644 | A | 11/1987 | Barone et al. | |
| 5,104,567 | A | 4/1992 | Staehr | |
| 5,143,639 | A | 9/1992 | Krawack | |
| 5,380,453 | A | 1/1995 | Krawack | |
| 5,382,677 | A | 1/1995 | Colignon et al. | |
| 5,391,783 | A | 2/1995 | Colignon et al. | |
| 5,397,494 | A | 3/1995 | Vega et al. | |
| 5,429,773 | A | 7/1995 | Sherry et al. | |
| 5,475,134 | A | 12/1995 | Baker | |
| 5,482,644 | A | 1/1996 | Nguyen et al. | |
| 5,602,089 | A | 2/1997 | Pennaz | |
| 5,616,781 | A | 4/1997 | Sajic et al. | |
| 5,637,560 | A | 6/1997 | Raehse et al. | |
| 5,637,758 | A | 6/1997 | Sajic et al. | |
| 5,688,982 | A | 11/1997 | Khan et al. | |
| 5,851,976 | A | 12/1998 | Mertens | |
| 5,945,394 | A | 8/1999 | Sajic et al. | |
| 5,965,500 | A | 10/1999 | Puvvada | |
| 5,968,893 | A | 10/1999 | Manohar et al. | |
| 5,972,861 | A | 10/1999 | Rolfes | |
| 6,013,611 | A | 1/2000 | Thomas et al. | |
| RE36,593 | E | 2/2000 | Emery | |
| 6,046,151 | A | 4/2000 | Drapier et al. | |
| 6,057,280 | A | 5/2000 | Huish et al. | |
| 6,060,440 | A | 5/2000 | Sackariasen et al. | |
| 6,407,050 | B1 | 6/2002 | Huish et al. | |
| 6,468,956 | B1 | 10/2002 | Huish et al. | |

FOREIGN PATENT DOCUMENTS

| | | |
|---|---|---|
| EP | 0 336 740 | 1/1995 |

OTHER PUBLICATIONS

Technical Bulletin—"Empigen OB / EBA" by Albright & Wilson.
Synthetic Detergents (7th ed.) A.S. Davidsohn & B. Milwidsky pp. 263–264.
Foster, Norman C. et al., "Manufacture of Methyl Ester Sulfonates and Other Derivatives," Chemithon, Seattle, Washington (1997).
Hovda, K., "The Challenge of Methylester Sulfonation," Chemithon, Seattle, Washington (1997).
MacArthur, et al., "Meeting the Challenge of Methylester Sulfonation," Chemithon, Seattle, Washington (1998).
Foster, Norman, "Sulfonation and Sulfation Processes," Chemithon, Seattle, Washington (1997).
Hovda, Keith, "Methyl Ester Sulfonation: Process Optimization," Chemithon, Seattle, Washington (1993).
Foster et al., "Medium to Very High Active Step Neutralization," Chemithon, Seattle, Washington (1997).
"Surfactants," Inform, vol. 7(1):10–12 (Jan. 1996).
U.S. patent application No. 10/278,161, filed Oct. 21, 2002 (Attorney Docket No. 020463–000210US).
U.S. patent application No. 10/174,541, filed Jun. 18, 2002 (Attorney Docket No. 020463–000910US).
U.S. patent application No. 09/574,998, filed May 19, 2000 (Attorney Docket No. 020483–000600US).

* cited by examiner

*Primary Examiner*—Necholus Ogden
(74) *Attorney, Agent, or Firm*—Townsend and Townsend and Crew, LLP

(57) ABSTRACT

A light duty liquid compositions comprising α-sulfofatty acid ester, hydrotrope, and nonionic surfactant. The α-sulfofatty acid ester and the hydrotrope stabilize the composition, by reducing pH drift and/or solubilizing the α-sulfofatty acid ester in solution. Methods are also disclosed for making such compositions.

22 Claims, No Drawings

LIQUID CLEANING COMPOSITION CONTAINING α-SULFOFATTY ACID ESTER

BACKGROUND OF THE INVENTION

The present invention generally relates to cleaning compositions and methods for making and using such compositions. More particularly, the invention relates to light duty liquid cleaning compositions containing α-sulfofatty acid ester and methods for making and using such compositions.

Soaps made from animal fats have been used for many years to clean dishes, utensils and other materials. More recently, cleaning compositions have been formulated using other surfactants to enhance their cleaning performance. Typical surfactants include anionics, nonionics, zwitterionics, ampholytics, cationics and those described in *Surface Active Agents*, Volumes I and II by Schwartz, Perry and Berch (New York, Interscience Publishers), in *Nonionic Surfactants*, ed. by M. J. Schick (New York, M. Dekker, 1967), and in McCutcheon's *Emulsifiers & Detergents* (1989 Annual, M.C. Publishing Co.), the disclosures of which are incorporated herein by reference.

Nonionic surfactants provide good cleaning properties and can also act as defoaming agents. Nonionic surfactants are typically manufactured by alkoxylation of alcohols, fatty acids or esters. For example, nonionic surfactants can be synthesized by ethoxylating an alcohol or fatty acid with ethylene oxide; ethoxylation adds ethoxy groups ($—OCH_2CH_2—$) to the active hydrogen of the alcohol or fatty acid. (See, e.g., U.S. Pat. Nos. 5,627,121; 4,835,321; 4,820,673; 4,775,653; 4,754,075; 4,239,917; and International Patent Publication No. WO 85/00365, the disclosures of which are incorporated herein by reference.) Other nonionic surfactants include amine oxides and alkanolamides. Alkanolamides can be alkoxylated to form alkoxylated alkanolamides. (See, e.g., U.S. Pat. Nos. 6,034,257 and 6,034,257, the disclosures of which are incorporated herein by reference.) Nonionic surfactants alone, however, generally lack sufficient cleaning performance for some light duty applications.

Nonionic surfactants are often combined with inorganic or organic salts of a polyvalent metal cation, particularly magnesium cations. The metal salts provide several benefits, such as improved cleaning performance in dilute usage, particularly in soft water areas. Although magnesium is the preferred multivalent metal from which the salts are formed, other polyvalent metal ions can also be used. The use of polyvalent metal salts can be limited, however, because they can be insoluble in the aqueous phase of the system. In particular, changes in the pH of the aqueous phase can cause precipitation of the metal salts and deposition of dishes or utensils cleaned with the composition.

Anionic surfactants can also be combined with nonionic surfactants. Recently, interest in α-sulfofatty acid esters (also referred to herein as "sulfofatty acids") as an anionic co-surfactant has increased due to the improved cleaning properties of this class of surfactants over a range of water hardness conditions. The use of α-sulfofatty acid esters has not been widely accepted, however, due to several disadvantages of such sulfofatty acids. One disadvantage is that di-salts form during manufacture of α-sulfofatty acid esters. (Di-salts form by hydrolysis of the ester bond of the α-sulfofatty acid ester to form sulfonated fatty acid salts.) While mono-salts of α-sulfofatty acid esters have the desired surface active agent properties, di-salts have several undesirable properties that degrade the performance of the resulting composition. For example, the Kraft point of a $C_{16}$ methyl ester sulfonate ("MES") di-salt is 65° C., as compared to 17° C. for the mono-salt form of $C_{16}$ MES. (The Kraft point is the temperature at which the solubility of an ionic surfactant becomes equal to its critical micelle concentration; below the Kraft point, surfactants form precipitates instead of micelles.) Thus, the higher the Kraft point leads to more di-salt precipitates from the composition. The resulting poor di-salt solubility in cool and even slightly hard water is a disadvantage in most applications. The presence of large amounts of di-salt in α-sulfofatty acid ester, therefore, results in a poorer quality α-sulfofatty acid ester product, characterized by degraded performance and reduced application flexibility.

A related problem is that di-salts form during storage and in detergent formulations. In particular, mono-salts of α-sulfofatty acid ester hydrolyze in the presence of moisture and a high pH component to form di-salts. For example, in detergent formulations where MES is well mixed with high pH components under aqueous conditions, the MES will hydrolyze nearly completely to the di-salt form. High pH components include builders, such as silicates or carbonates, and bases, such as sodium hydroxide (NaOH). This chemical instability discourages the use of α-sulfofatty acid esters in many applications.

Another problem associated with α-sulfofatty acid ester-containing detergent compositions is pH drift in unbuffered liquid formulations. In concentrated solutions of such sulfofatty acids, the pH of the solution drifts towards the acidic (lower) range. pH drift interferes with other cleaning components in the composition. To prevent pH drift, buffering or alkalizing agents are added to detergents. Buffering or alkalizing agents, such as caustic soda (NaOH), cause additional di-salt formation, however, which decreases the performance of the α-sulfofatty acid ester.

α-Sulfofatty acid esters also have limited solubility in concentrated solutions. For example, phase separation occurs in concentrated aqueous solutions of $C_{16}$ or $C_{18}$ α-sulfofatty acid esters if the sulfofatty acid ester is not adequately solubilized.

Thus, there is a need for light duty liquid cleaning compositions comprising α-sulfofatty acid ester that exhibit reduced di-salt formation. There is a further need for a light duty liquid in cleaning compositions that are stabilized and exhibit reduced pH drift and/or phase separation by the α-sulfofatty acid ester.

SUMMARY OF THE INVENTION

The present invention provides cleaning compositions comprising α-sulfofatty acid ester. Effective amounts of α-sulfofatty acid ester and hydrotrope are combined to form a cleaning composition, such as a light duty liquid cleaning composition. The composition further includes nonionic surfactant, such as alkoxylated alkanolamide and/or amine oxide.

The α-sulfofatty acid ester and the hydrotrope form a stabilized composition. In one embodiment, the hydrotrope solubilizes the α-sulfofatty acid ester in solution and reduces phase separation. In a second embodiment, effective amounts of the α-sulfofatty acid ester and the hydrotrope reduce pH drift in the composition, thereby reducing additional di-salt formation. In another embodiment, effective amounts of the α-sulfofatty acid ester and the hydrotrope reduce additional di-salt formation by sparing the need for alkalizing agents. In still another embodiment, effective amounts of the α-sulfofatty acid ester and the hydrotrope provide multiple stabilizing effects. In a preferred embodiment, the hydrotrope is urea. The urea is typically substantially free of ammonium carbamate.

The nonionic surfactants can be, for example, an alkoxylated alkanolamide and/or an amine oxide. The nonionic surfactants improve the cleaning performance of the composition. In a preferred embodiment the nonionic surfactant and α-sulfofatty acid ester spare the requirement for polyvalent metal salts. The composition can optionally include other cleaning components, such as, for example, alkyl poly-glucosides, n-methyl glucamides and other glucose and/or galactose derived surfactants.

Methods of making cleaning compositions comprising α-sulfofatty acid ester are also provided. Such methods generally include providing α-sulfofatty acid ester, hydrotrope and nonionic surfactant, and mixing these components to form the composition. The method optionally further includes adding other cleaning components to the composition, such as, for example, alkyl poly-glucosides, n-methyl glucamides, and other glucose and/or galactose derived surfactants.

DETAILED DESCRIPTION OF THE PREFERRED EMBODIMENTS

The following description provides specific details, such as materials and dimensions, to provide a thorough understanding of the present invention. The skilled artisan, however, will appreciate that the present invention can be practiced without employing these specific details. Indeed, the present invention can be practiced in conjunction with processing, manufacturing or fabricating techniques conventionally used in the detergent industry. Moreover, the processes below describe only steps, rather than a complete process flow, for manufacturing the composition.

A preferred embodiment is directed to compositions comprising α-sulfofatty acid ester, hydrotrope, and nonionic surfactants. The α-sulfofatty acid ester, hydrotrope, and nonionic surfactants are combined to form a composition according to the present invention.

The α-Sulfofatty Acid Ester

In a preferred embodiment, the composition comprises at least one α-sulfofatty acid ester. Such sulfofatty acid has an ester linkage between a carboxylic acid and an alkanol and is sulfonated at the α-position of the carboxylic acid. The α-sulfofatty acid ester is typically of the following formula (I):

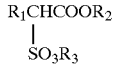

(I)

where $R_1$ is a linear or branched alkane, $R_2$ is a linear or branched alkane, and $R_3$ is hydrogen, a halogen, a monovalent or di-valent cation, or an unsubstituted or substituted ammonium cation. $R_1$ can be a $C_4$–$C_{24}$, including a $C_8$, $C_{10}$, $C_{12}$, $C_{14}$, $C_{16}$ and/or $C_{18}$ alkane. $R_2$ can be $C_1$ to $C_8$, including a methyl group. $R_3$ is typically a mono-valent or di-valent cation, such as a cation that forms a water soluble salt with the α-sulfofatty acid ester (e.g., an alkali metal salt such as sodium, potassium or lithium). The α-sulfofatty acid ester of formula (I) can be a methyl ester sulfonate, such as a $C_8$ to $C_{18}$ methyl ester sulfonate.

More typically, the α-sulfofatty acid ester is of the following formula (II):

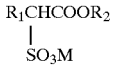

(II)

where $R_1$ and $R_2$ are alkanes and M is a monovalent cation. For example, $R_1$ can be an alkane containing 4 to 24 carbon atoms, and is typically a $C_8$, $C_{10}$, $C_{12}$, $C_{14}$, $C_{16}$ and/or $C_{18}$ alkane. $R_2$ typically an alkane containing 1 to 8 carbon atoms, and more typically a methyl group. M is typically an alkali metal, such as sodium or potassium cations. The α-sulfofatty acid ester of formula (II) can be a sodium methyl ester sulfonate, such as a sodium $C_8$–$C_{18}$ methyl ester sulfonate.

In one embodiment, the α-sulfofatty acid ester is a $C_8$, $C_{10}$, $C_{12}$, $C_{14}$, $C_{16}$ or $C_{18}$ α-sulfofatty acid ester. In another embodiment, the α-sulfofatty acid ester comprises a mixture of α-sulfofatty acid esters. For example, the composition can comprise a mixture of $C_8$, $C_{10}$, $C_{12}$, $C_{14}$, $C_{16}$ and $C_{18}$ α-sulfofatty acid esters. Such a mixture can be prepared from a natural fat or oil, such as any of those described below.

In yet another embodiment, the α-sulfofatty acid ester is a mixture of different chain lengths, where the proportions of the different chain lengths are selected according to the properties of the α-sulfofatty acid esters. For example, $C_{16}$ and $C_{18}$ sulfofatty acids (e.g., from tallow and/or palm stearin MES) generally provide better surface active agent properties, but are less soluble in aqueous solutions. $C_8$, $C_{10}$, $C_{12}$ and $C_{14}$ α-sulfofatty acid esters (e.g., from palm kernel oil or coconut oil) are more soluble in water, but have lesser surface active agent properties. Suitable mixtures further include $C_8$, $C_{10}$, $C_{12}$ and/or $C_{14}$ α-sulfofatty acid esters combined with $C_{16}$ and/or $C_{18}$ α-sulfofatty acid esters in ranges from about 1 to about 99 percent of $C_8$, $C_{10}$, $C_{12}$ and/or $C_{14}$ α-sulfofatty acid ester to about 99 to about 1 weight percent of $C_{16}$ and/or $C_{18}$ α-sulfofatty acid ester. Other suitable mixtures include about 1 to about 99 weight percent of $C_{16}$ α-sulfofatty acid ester and about 99 to about 1 weight percent of $C_{18}$ α-sulfofatty acid ester.

The composition can also be enriched for certain α-sulfofatty acid esters, as disclosed in co-pending U.S. patent application Ser. No. 09/574,996, filed May 19, 2000, to provide the desired surfactant properties. The disclosure of that application is incorporated by reference herein in its entirety. For example, α-sulfofatty acid esters prepared from natural sources, such as palm kernel (stearin) oil, palm kernel (olein) oil, or beef tallow, are enriched for $C_{16}$ and/or $C_{18}$ α-sulfofatty acid esters by addition of the certain chain length (purified or semi-purified) α-sulfofatty acid esters to a mixture of α-sulfofatty acid esters. α-Sulfofatty acid esters prepared from other sources can also be enriched for one or more chain length α-sulfofatty acid esters, such as $C_{16}$ and/or $C_{18}$ α-sulfofatty acid esters. For enrichment of $C_{16}$ or $C_{18}$ to other chain length α-sulfofatty acid esters, suitable ratios for enrichment range from greater than 0.5:1, to about 1:1, to about 1.5:1, to greater than 2:1, and up to about 5–6:1, or more. An enriched mixture can also comprise about 50 to about 60 weight percent $C_8$–$C_{18}$ α-sulfofatty acid esters and about 50 to about 40 weight percent $C_{16}$ α-sulfofatty acid ester, based on the total weight of the α-sulfofatty acid esters.

Methods of preparing α-sulfofatty acid esters are known to the skilled artisan. (See, e.g., U.S. Pat. Nos. 5,587,500; 5,384,422; 5,382,677; 5,329,030; 4,816,188; and 4,671,900; and *The Journal of American Oil Chemists Society* 52:323–29 (1975); the disclosures of which are incorporated herein by reference. α-Sulfofatty acid esters can be prepared from a variety of sources of fatty acids, including beef tallow, palm kernel oil, palm kernel (olein) oil, palm kernel (stearin) oil, coconut oil, soybean oil, canola oil, cohune oil, coco butter, palm oil, white grease, cottonseed oil, corn oil, rape seed oil, yellow grease, mixtures thereof or fractions thereof. Other examples of fatty acids that can be used to make α-sulfofatty acid esters include caprylic ($C_8$), capric ($C_{10}$), lauric ($C_{12}$), myristic ($C_{14}$), myristoleic ($C_{14}$), palmitic ($C_{16}$), palmitoleic ($C_{16}$), ($C_{18}$), oleic ($C_{18}$), linoleic ($C_{18}$), linolenic ($C_{18}$), ricinoleic ($C_{18}$), arachidic ($C_{20}$), gadolic ($C_{20}$), behenic ($C_{22}$) and erucic ($C_{22}$) fatty acids. α-Sulfofatty acid esters prepared from one or more of these starting materials are within the scope of the present invention.

Compositions according to the present invention comprise an effective amount of α-sulfofatty acid ester (i.e., an amount that provides the desired anionic surface active agent properties). In one embodiment, an effective amount is at least about 5 weight percent α-sulfofatty acid ester. In another embodiment, an effective amount is at least about 10 weight percent α-sulfofatty acid ester. In still another embodiment, an effective amount is at least about 15 weight percent, at least about 20 weight percent, or at least about 25 weight percent. In other embodiments, the effective amount of α-sulfofatty acid ester is at least about 35 weight percent. These weight percentages are based on the total weight of the composition.

Hydrotrope

The composition also comprises an effective amount of at least one hydrotrope. The hydrotrope provides one or more stabilizing effects to the α-sulfofatty acid ester-containing composition. In one embodiment, the hydrotrope aids in a solubilizing the α-sulfofatty acid ester in an aqueous solution. In another embodiment, the hydrotrope reduces phase separation of the α-sulfofatty acid ester from aqueous components. Effective amounts of hydrotrope to aid in solubilizing α-sulfofatty acid in solution, and/or to reduce phase separation, are determined by, for example, titrating a solution containing the α-sulfofatty acid ester until the desired quantity of α-sulfofatty acid ester is solubilized.

In another embodiment, effective amounts of the α-sulfofatty acid ester and the hydrotrope stabilize the composition by reducing pH drift towards either more acidic or more basic pH values. The α-sulfofatty acid ester is combined with an effective amount of the hydrotrope to stabilize the pH of the composition within a desired range, as compared with a non-stabilized composition. In still another embodiment, effective amounts of the α-sulfofatty acid ester and the hydrotrope stabilize the composition by reducing pH drift outside the desired pH range. According to this embodiment, the effective amount of the hydrotrope is determined, for example, according to the intended shelf life of the composition, so that the pH of the composition remains within the desired pH range during storage.

Effective amounts of the α-sulfofatty acid ester and the hydrotrope stabilize the pH of the composition, so that no more than a minor amount of additional di-salt forms in the composition. to The hydrotrope can stabilize the composition by reducing pH drift and/or sparing the requirement for alkalizing agents. As used herein, the term "minor amount" means no more than about 30 weight percent additional di-salt. More typically, a minor amount is no more than about 15 weight percent additional di-salt, or no more than about 7 weight percent additional di-salt. As will be appreciated by the skilled artisan, the preceding ranges apply to additional di-salt formation and exclude di-salt already present in the α-sulfofatty acid ester as a result of the manufacturing process. The method of George Battaglini et al., *Analytical Methods for Alpha Sulfo Methyl Tallowate*, JOACS, Vol. 63, No. 8 (August 1986), can be used to determine the amount of di-salt in an α-sulfofatty acid ester sample, and any increase in such a sample as compared with a control sample. The disclosure of this publication is incorporated by reference herein in its entirety.

In still another embodiment, the hydrotrope provides more than one stabilizing effect. For example, the hydrotrope can aid in solubilizing the α-sulfofatty acid ester and reduce pH drift, thereby reducing di-salt formation.

The hydrotrope is typically urea. The urea generally contains little to no ammonium carbamate. For example, urea which is substantially free of ammonium carbamate contains less than about 0.1 weight percent ammonium carbamate. An effective amount of urea is combined with an effective amount of α-sulfofatty acid ester to aid in solubilizing the α-sulfofatty acid ester in solution and/or to reduce pH drift. For example, in some applications an effective amount of α-sulfofatty acid ester ranges from about 5 to about 35 weight percent and an effective amount of urea ranges from about 1 to about 30 weight percent, where the weight percentages are based on the total weight of the composition. In other applications, the effective amount of urea ranges from about 15 to about 20 weight percent, from about 7.5 to about 10 weight percent, or from about 7.5 to about 20 weight percent. The effective amount of urea is determined, for example, by titrating a solution containing α-sulfofatty acid ester(s) until the desired stabilizing effect is achieved.

The Nonionic Surfactant

The cleaning composition further comprises at least one nonionic surfactant. More typically, the compositions comprises at least two nonionic surfactants. In one embodiment, the cleaning composition comprises an amine oxide and an alkanolamide.

The amine oxide is typically of the formula (III):

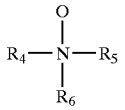

(III)

where $R_4$ is a $C_4$–$C_{20}$ group, such as alkyl, hydroalkyl (e.g., 2-hydroxyethyl, 2-hydroxypropyl, 3-hydroxypropyl, polyols, and the like) or alkoxylated alkyl, in which the alkyl and alkoxy contain from 1 to 20, and 2–3, carbon atoms, respectively. $R_5$ and $R_6$ are each independently selected from $C_1$–$C_8$ alkyl (e.g., methyl, ethyl, propyl, isopropyl, and the like), hydroalkyl (e.g., 2-hydroxyethyl, 2-hydroxypropyl, 3-hydroxypropyl, polyols and the like) or alkoxylated alkyl, in which the alkyl and alkoxy contain from 1 to 8 and 2–3 carbon atoms, respectively. The degree of alkoxylation can range from 0 to about 10, or more. Suitable amine oxides and alkoxylated amine oxides are also described in U.S. Pat. No. 4,316,824, the disclosure of which is hereby incorporated herein by reference.

In a preferred embodiment, the amine oxide is a tertiary amine oxide of the following formula (III):

(III)

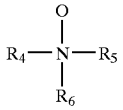

where $R_4$ is a $C_8$–$C_{16}$ alkane and $R_5$ and $R_6$ are independently selected from methyl or ethyl. For example, suitable tertiary amines include $C_{12}$–$C_{14}$ dimethyl amine oxides, such as those manufactured by Albright and Wilson Americas Inc. (Glen Allen, Va.) and sold under the trade mark EMPIGEN® OB/EBA.

Cleaning compositions in accordance with the present invention contain an effective amount of the amine oxide (e.g., an amount which enhances soil removal). Typically, an effective amount is at least about one weight percent, more typically about 5 weight percent to about 10 weight percent, or more.

The alkanolamide is generally of the following formula (IV):

(IV)

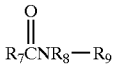

where $R_7$ is an alkyl (e.g., a $C_4$–$C_{24}$ alkane), alkenyl (e.g., a $C_4$–$C_{24}$ alkene), alkylene (e.g., a $C_4$–$C_{24}$ alkylene), or hydroalkyl (e.g., a $C_4$–$C_{24}$ alkanol or polyol) group. $R_8$ and $R_9$ are independently selected from hydrogen, alkyl (e.g., a $C_1$–$C_8$ alkane), hydroalkyl (e.g., a $C_1$–$C_8$ alkanol or polyol), or alkoxylated alkyl (e.g., $C_1$–$C_8$ hydroalkyl groups linked to a $C_2$–$C_{24}$ alkane). $R_7$ is typically an alkyl group containing 6 to 22 carbon atoms. The alkanolamide can be, for example, a $C_{18}$ monoethanolamide or an alkanolamide prepared from coconut oil or palm kernel oil, such as those manufactured by Albright and Wilson Americas Inc. (Glen Allen, Va.) and sold under the trade mark EMPILAN® CME.

The alkanolamide is typically an alkoxylated alkanolamide of the following formula (V):

(V)

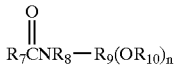

where $R_7$ is an alkyl (e.g., a $C_4$–$C_{24}$ alkane), alkenyl (e.g., a $C_4$–$C_{24}$ alkene), alkylene (e.g., a $C_4$–$C_{24}$ alkylene), hydroalkyl (e.g., a $C_4$–$C_{24}$ alkanol or polyol) or alkoxylated alkyl. $R_{10}$ is an alkyl group, and n is a positive integer. $R_8$ and $R_9$ are independently selected from hydrogen, alkyl (e.g., a $C_1$–$C_8$ alkane), hydroalkyl (e.g., a $C_1$–$C_8$ alkanol) or alkoxylated alkyl (e.g., $C_1$–$C_8$ hydroalkyl groups linked to a $C_2$–$C_{24}$ alkane). $R_7$ is typically an alkyl group containing 6 to 22 carbon atoms. $R_{10}$ is typically a $C_1$–$C_3$ alkane. The degree of alkoxylation (the molar ratio of the oxyalkyl groups per mole of alkanolamide) can range from about 1 to about 100, or from about 3 to about 8, or about 5 to 6. The alkoxylated alkanolamide is typically an alkoxylated monoalkanolamide, such as a $C_{18}$ alkoxylated monoalkanolamide or an alkoxyated alkanolamide prepared from coconut oil (e.g., EMPLIAN® MAA from Albright and Wilson Americas Inc. (Glen Allen, Va.)) or palm kernel oil.

Methods of manufacturing alkoxylated alkanolamides are known to the skilled artisan. (See, e.g., U.S. Pat. Nos. 6,034,257 and 6,034,257, the disclosures of which are incorporated by reference herein.) Sources of fatty acids for the manufacture of alkanolamides include beef tallow, palm kernel oil, palm stearin oil, palm olein oil, coconut oil, soybean oil, canola oil, cohune oil, coco butter, palm oil, white grease, yellow grease, cottonseed oil, corn oil, rape seed oil, and mixtures or fractions thereof. Suitable fatty acids for the manufacture of alkanolamides further include caprylic ($C_8$), capric ($C_{10}$), lauric ($C_{12}$), myristic ($C_{14}$), myristoleic ($C_{14}$), palmitic ($C_{16}$), palmitoleic ($C_{16}$), stearic ($C_{18}$), oleic ($C_{18}$), linoleic ($C_{18}$), linolenic ($C_{18}$), ricinoleic ($C_{18}$arachidic ($C_{20}$), gadolic ($C_{20}$), behenic ($C_{22}$) and erucic ($C_{22}$) fatty acids. Alkanolamides prepared from one or more of these starting materials are within the scope of the present invention.

The alkanolamide is typically present in an effective amount, such as at least about one weight percent, more typically about 2.5 weight percent to about 5 weight percent, or more.

Other Components

The composition can optionally include other cleaning components, such as preservatives, fragrance, chelating agents (e.g., ethylene diamine tetraacetic acid), dyes, solvents (e.g., water, alcohol, and the like), enzymes, and other components commonly used in the field. In a preferred embodiment, the composition is free of substances that cause more than a minor amount of additional di-salt formation.

Suitable preservatives include, for example, DOWICIL® 75 (CAS/ID No.: 004080-31-3), KATHON® CG/CIP (3(2H)-isothiazolone, 5-chloro-2-methyl-, mixed with 2 methyl-3(2H) isothiazolone), Surcide P (hexahydro-1,3,5,-tris(2-hydroxyethyl)-s-triazine) and bronopol (2-nitro-2-bromo-1,3-propanediol).

The composition optionally includes secondary nonionic surfactants, such as those containing an organic hydrophobic group and a hydrophilic group that is a reaction product of a solubilizing group (such as a carboxylate, hydroxyl, amido or amino group) with an alkylating agent, such as ethylene oxide, propylene oxide), or a polyhydration product thereof (such as polyethylene glycol). Such nonionic surfactants include, for example, polyoxyalkylene alkyl ethers, polyoxyalkylene alkylphenyl ethers, polyoxyalkylene sorbitol fatty acid esters, polyoxyalkylene sorbitol fatty acid esters, polyalkylene glycol fatty acid esters, alkyl polyalkylene glycol fatty acid esters, polyoxyethylene polyoxypropylene alkyl ethers, polyoxyalkylene castor oils, polyoxyalkylene alkylamines, and glycerol fatty acid esters. Other suitable surfactants include those disclosed in U.S. Pat. Nos. 5,945,394 and 6,046,149, the disclosures of which are incorporated herein by reference.

In another embodiment, the composition contains only minor amounts of secondary nonionic surfactants. As used herein, a "minor amount" of secondary nonionic surfactant is between about 0.5 and about 5 weight percent. Alternatively, the composition is substantially free of secondary nonionic surfactants. In this context, the term "substantially free" means less than about one weight percent.

The composition also optionally includes a secondary anionic surfactant. Suitable secondary anionic surfactants includes those surfactants that contain a long chain hydrocarbon hydrophobic group in their molecular structure and a hydrophilic group (i.e., water solubilizing group), such as carboxylate, sulfonate, sulfate or phosphate groups. Suitable secondary anionic surfactants include salts, such as sodium, potassium, calcium, magnesium, barium, iron, ammonium and amine salts. Other suitable secondary anionic surfactants include the alkali metal, ammonium and alkanol ammonium salts of organic sulfuric reaction products having in their molecular structure an alkyl or alkaryl group containing from 8 to 22 carbon atoms and a sulfonic or sulfuric acid group. Examples of such anionic surfactants include water soluble salts of alkyl benzene sulfonates having between 8 and 22 carbon atoms in the alkyl group, and alkyl ether sulfates having between 8 and 22 carbon atoms in the alkyl group. Other anionic surfactants include polyethoxylated alcohol sulfates, such as those sold under the trade name CALFOAM® 303 (Pilot Chemical Company, California). Examples of other anionic surfactants are disclosed in U.S. Pat. No. 3,976,586, the disclosure of which is incorporated by reference herein.

In another embodiment, the composition comprises only minor amounts of secondary anionic surfactants. As used in this context, a "minor amount" of secondary anionic surfactant is between about 0.5 and about 5 weight percent. Alternatively, the composition is substantially free of secondary anionic surfactants. In this context, the term "substantially free" means less than about one weight percent.

Suitable solvents include water, a $C_1$–$C_4$ alcohol, a mixture of water and a $C_1$–$C_4$ monohydric alcohol (e.g., ethanol, propanol, isopropanol, butanol, and mixtures thereof), and the like. In one embodiment, the solvent comprises from about 90% to about 5% by weight, typically about 40% to about 75% of the composition. Other suitable components include diluents. Diluents can be inorganic salts, such as sodium and potassium sulfate, ammonium chloride, sodium and potassium chloride, sodium bicarbonate, and the like. Such diluents can be present at levels of from about 0 weight percent to about 10 weight percent, preferably from about 0 to about 5 weight percent.

The composition can optionally include sugar-based surfactants. Such sugar-based surfactants include alkyl polyglucosides, alkyl polysaccharides, glucosamides, (e.g., n-methyl glucamide), sucroglycerides, alkylglucosamides, and alkylglucosides. In another embodiment, the composition is substantially free of sugar-based surfactant. In the context of sugar-based surfactants, the term "substantially free of" means less than about one weight percent of the recited component.

The composition can optionally further include an inorganic or organic salt or oxide of a polyvalent metal cation, particularly magnesium. The metal salt or oxide can provide several benefits including improved cleaning performance in dilute usage, particularly in soft water areas. Magnesium sulfate, magnesium oxide, magnesium chloride, magnesium acetate, magnesium propionoate, and magnesium hydroxide are suitable magnesium salts. Other suitable polyvalent metal ions are those that are nontoxic and are soluble in the aqueous phase of the system at the desired pH level. Thus, depending on such factors as the pH of the system, the surfactants, and so on, other suitable polyvalent metal ions, such as aluminum, copper, nickel, iron, calcium, and the like can be included in the composition. The proportion of the multivalent salt generally will typically be from 0 to about 6 weight percent, more typically from about 1 to about 5 weight percent.

In a preferred embodiment, the α-sulfofatty acid ester spares the requirement for multivalent salts. The α-sulfofatty acid ester typically reduces the requirement for the multivalent salt as compared with a composition that does not contain the α-sulfofatty acid ester. In an alternative embodiment, the composition is substantially free of multivalent salts. In this context, substantially free means less than about one weight percent.

Compositions according to the present invention are formed by any suitable method known to the skilled artisan. Typically, effective amounts of α-sulfofatty acid ester, hydrotrope, and nonionic surfactant are combined to form the composition. In one embodiment, the hydrotrope is solubilized in a solvent (e.g., water) prior to the addition of the α-sulfofatty acid ester and the other components. Other suitable methods include those described in *Perry's Chemical Engineers' Handbook* ($6^{th}$ Ed.), chapter 19 (1984), the disclosure of which is incorporated by reference herein). In another embodiment, effective amounts of α-sulfofatty acid ester, hydrotrope, and nonionic surfactant, and other components are combined, according to the desired properties of the final composition. For example, the α-sulfofatty acid ester, hydrotrope and nonionic surfactant are combined in a mixer, other cleaning components are added, then the components are mixed to form a composition according to the present invention.

Other embodiments of the present invention are exemplified in the following examples, though the invention is not intended to be limited by or to these examples.

EXAMPLE 1

A light duty liquid cleaning composition is formulated by combining the following components:

| | |
|---|---|
| α-sulfofatty acid ester | 5–10 weight percent |
| amine oxide | 11–22 weight percent |
| alkoxylated alkanolamide | 2.5–5 weight percent |
| hydrotrope | 7.5–20 weight percent |
| Other components and water | balance |

EXAMPLE 2

To compare the effects of varying the relative amounts of α-sulfofatty acid ester, amine oxide and alkanolamide, compositions were prepared as described below in the following examples. Each composition further contained 20 weight percent urea, 0.1 weight percent fragrance, and 0.1 weight percent preservative. The amounts of α-sulfofatty acid ester, amine oxide and alkanolamide were varied within the following ranges:

| | |
|---|---|
| α-sulfofatty acid ester | 27.2–36 weight percent |
| nonionic surfactant (as amine oxide) (EMPIGEN ® OB/EBA) | 1.6–10.4 weight percent |
| nonionic surfactant (as alkanolamide) (EMPILAN ® CME) | 0–2.4 weight percent |

The balance of each composition was water.

EXAMPLE 3

The effect of varying the amounts of α-sulfofatty acid ester, amine oxide, alkoxylated alkanolamide on soil titration and foam stability was determined. Soil titration was measured using a soil titration assay (Shell soil titration test (see, e.g., U.S. Pat. No. 5,476,614, which is incorporated by reference herein)), and the Ross Miles foam height assay (see, e.g., ASTM designation D-1173-53; U.S. Pat. No.

5,859,218; each of which is incorporated by reference herein) was used to quantify foam stability.

Compositions 65, 68, 67, 73 and 71 were prepared as according to the following formulations:

| | Composition | | | | |
|---|---|---|---|---|---|
| Component | 65 | 68 | 67 | 73 | 71 |
| Urea | 20 | 20 | 20 | 20 | 20 |
| Palm Kernel Oil MES | 24 | 24 | 24 | 24 | 24 |
| $C_{16}$-MES | 12 | 12 | 7.6 | 5.6 | 3.2 |
| Coconut Monoethanolamide | 2.4 | 0 | 2.4 | 0 | 2.4 |
| Amine Oxide | 1.6 | 4 | 6 | 10.4 | 10.4 |
| Fragrance | 0.1 | 0.1 | 0.1 | 0.1 | 0.1 |
| Preservatives | 0.1 | 0.1 | 0.1 | 0.1 | 0.1 |
| Water | Balance | Balance | Balance | Balance | Balance |

The following test results were obtained:

| | Composition | | | | |
|---|---|---|---|---|---|
| Test | 65 | 68 | 67 | 73 | 71 |
| Soil titration (grams) | 3.575 | 4.095 | 4.333 | 5.065 | 4.698 |
| Initial Foam Height (mm) | 159 | 165 | 163 | 160 | 165 |
| Final Foam Height (mm) | 143 | 151 | 146 | 142 | 147 |

As can be seen from these results, increasing the amount of nonionic surfactant (coconut monoethanolamide and amine oxide) markedly improves soil removal with only minor differences in foam height. (Compare Compositions 65 and 71.) Furthermore, increasing the amount of nonionic surfactant can spare the requirement for α-sulfofatty acid ester. (Compare Compositions 68 and 73.)

EXAMPLE 4

Compositions 70 and 74–76 were prepared as described below and tested as described in Example 3.

| | Composition | | | |
|---|---|---|---|---|
| Component | 74 | 76 | 70 | 75 |
| Urea | 20 | 20 | 20 | 20 |
| Palm Kernel Oil MES | 22.8 | 22.8 | 22 | 21.2 |
| $C_{16}$-MES | 10.8 | 7.6 | 10 | 9.2 |
| Coconut Monoethanolamide | 0.8 | 0.8 | 0 | 2.4 |
| Amine Oxide | 6 | 9.2 | 8.4 | 7.6 |
| Fragrance | 0.1 | 0.1 | 0.1 | 0.1 |
| Preservatives | 0.1 | 0.1 | 0.1 | 0.1 |
| Water | Balance | Balance | Balance | Balance |

The following test results were obtained:

| | Composition | | | |
|---|---|---|---|---|
| Test | 74 | 76 | 70 | 75 |
| Soil titration (grams) | 4.410 | 5.383 | 4.895 | 4.943 |
| Initial Foam Height (mm) | 170 | 165 | 161 | 163 |

-continued

| | Composition | | | |
|---|---|---|---|---|
| Test | 74 | 76 | 70 | 75 |
| Final Foam Height (mm) | 151 | 147 | 143 | 144 |

As can be seen by comparing compositions 70, 74 75 and 76, an increase in nonionic surfactant markedly increases soil titration while sparing the requirement for α-sulfofatty acid ester.

EXAMPLE 5

Compositions 63–64 and 69 were prepared as described below and compared with a popular, name brand light duty dishwashing liquid (designated the control), according to the assays described in Example 3.

| | Composition | | |
|---|---|---|---|
| Component | 63 | 69 | 64 |
| Urea | 20 | 20 | 20 |
| Palm Kernel Oil MES | 17.6 | 17.6 | 15.2 |
| $C_{16}$-MES | 12 | 12 | 12 |
| Coconut Monoethanolamide | 0 | 0 | 2.4 |
| Amine Oxide | 10.4 | 10.4 | 10.4 |
| Fragrance | 0.1 | 0.1 | 0.1 |
| Preservatives | 0.1 | 0.1 | 0.1 |
| Water | Balance | Balance | Balance |

The following test results were obtained:

| Component | 63 | 69 | 64 | Control |
|---|---|---|---|---|
| Soil titration (grams) | 5.920 | 5.455 | 5.933 | 5.826 |
| Initial Foam Height (mm) | 168 | 169 | 175 | 174 |
| Final Foam Height (mm) | 150 | 150 | 153 | 152 |

As can be seen by comparing compositions 64 and 69, adding alkanolamide markedly improves soil removal and the resulting combination of α-sulfofatty acid ester, hydrotrope, and nonionic surfactants provides performance comparable to the control.

Having thus described in detail the preferred embodiments of the present invention, it is to be understood that the invention defined by the appended claims is not to be limited by particular details set forth in the above description, as many apparent variations thereof are possible without departing from the spirit or scope of the invention.

What is claimed is:

1. A liquid cleaning composition, comprising a pH stabilized composition consisting essentially of effective amounts of α-sulfofatty acid ester and urea to solubilize the α-sulfofatty acid ester and reduce pH drift of the composition;

tertiary amine oxide;

alkoxylated alkanolamide; and optionally additional components;

whereby the amount of additional di-salt formation is reduced.

2. The composition of claim 1, wherein the α-sulfofatty acid ester is a methyl ester sulfonate.

3. The composition of claim 2, wherein the α-sulfofatty acid ester is a mixture of methyl ester sulfonates.

4. The composition of claim 1, wherein the α-sulfofatty acid ester is a $C_{16}$-enriched α-sulfofatty acid ester.

5. The composition of claim 1, wherein the alkanolamide is prepared from coconut oil or palm kernel oil.

6. The composition of claim 1, wherein the urea is substantially free of ammonium carbamate.

7. The composition of claim 1, wherein the amine oxide is an alkyl dimethylamine oxide.

8. The composition of claim 7, wherein the alkyl dimethylamine oxide is a mixture of $C_{12}$- and $C_{14}$-dimethyl amine oxides.

9. The composition of claim 1 which is substantially free of sugar-based surfactants.

10. The composition of claim 1 which is substantially free of other anionic surfactants.

11. A liquid cleaning composition, comprising a pH stabilized composition consisting essentially of effective amounts of α-sulfofatty acid ester and urea;

an amine oxide; and an alkanolamide;

whereby the stabilized composition reduces pH drift, and the amount of additional di-salt formation is reduced.

12. The composition of claim 11, wherein the α-sulfofatty acid ester is prepared from beef tallow, palm kernel oil, palm kernel oil olein, palm kernel oil stearin, coconut oil, soybean oil, canola oil, cohune oil, coco butter, palm oil, white grease, cottonseed oil, corn oil, rape seed oil, yellow grease, mixtures thereof, or fractions thereof.

13. The composition of claimed 11, wherein the α-sulfofatty acid ester is a methyl ester sulfonate.

14. The composition of claim 13, wherein the methyl ester sulfonate is a $C_{16}$-enriched methyl ester sulfonate.

15. The composition of claim 11, wherein the amine oxide is an alkyl dimethylamine oxide.

16. The composition of claim 11, wherein the alkanolamide is an alkoxylated alkanolamide.

17. A liquid cleaning composition, comprising a pH stabilized composition consisting essentially of effective amounts of α-sulfofatty acid ester and urea to solubilize the α-sulfofatty acid ester and reduce pH drift of the composition;

amine oxide; and alkoxylated alkanolamide;

wherein the cleaning composition is free of components which cause more than a minor amount of additional di-salt formation.

18. A method for making a cleaning composition, comprising:

combining an effective amount of α-sulfofatty acid ester and an effective amount of urea to form a pH stabilized composition which solubilizes the α-sulfofatty acid ester and stabilizes the pH of the composition, and adding amine oxide and alkanolamide, whereby the amount of additional di-salt formation is reduced.

19. The method of claim 18, further comprising:

enriching the $C_{16}$ content of the α-sulfofatty acid ester.

20. The method of claim 18, further comprising:

mixing other cleaning components with the α-sulfofatty acid ester, amine oxide, alkanolamide, and urea.

21. The method of claim 18, further comprising:

providing a source of α-sulfofatty acid ester.

22. The method of claim 18, wherein the urea is substantially free of ammonium carbamate.

* * * * *